United States Patent [19]

Donnis et al.

[11] 4,265,550

[45] May 5, 1981

[54] INK RIBBON CARTRIDGE INCLUDING A MOVABLE RIBBON TENSIONING GUIDE FOR A PRINTING MACHINE

[75] Inventors: Gian P. Donnis, Montalto Dora; Giancarlo C. Borca, Ivrea, both of Italy

[73] Assignee: Ing. C. Olivetti & C., S.p.A., Italy

[21] Appl. No.: 24,051

[22] Filed: Mar. 26, 1979

[51] Int. Cl.[3] ..... B41J 33/10

[52] U.S. Cl. ..... 400/196.1; 400/234; 400/236; 400/25; 400/26; 400/56

[58] Field of Search ..... 400/25, 26, 55, 56, 400/57, 59, 124, 194, 195, 196, 196.1, 207, 208, 234, 235.1, 236

[56] References Cited

U.S. PATENT DOCUMENTS

| | | | |
|---|---|---|---|
| 2,614,676 | 10/1952 | Pessoa | 400/196 |
| 2,755,905 | 7/1956 | Segui | 400/202 |
| 3,939,957 | 2/1976 | Bittner | 400/236 X |
| 3,995,731 | 12/1976 | Miller et al. | 400/196 X |
| 4,010,834 | 3/1977 | Linder | 400/55 X |
| 4,010,839 | 3/1977 | Guerrini et al. | 400/207 |
| 4,063,500 | 12/1977 | Abe | 400/235.1 X |
| 4,074,799 | 2/1978 | Hishida et al. | 400/234 X |
| 4,130,367 | 12/1978 | Guerrini et al. | 400/196 |
| 4,147,439 | 4/1979 | Coleochi | 400/234 |

FOREIGN PATENT DOCUMENTS

| | | | |
|---|---|---|---|
| 603257 | 9/1934 | Fed. Rep. of Germany | 400/194 |
| 2527979 | 1/1977 | Fed. Rep. of Germany | 400/194 |
| 2755090 | 7/1978 | Fed. Rep. of Germany | 400/196 |

OTHER PUBLICATIONS

IBM Technical Disclosure Bulletin "Floating Platen for Printing on Irregular Contours", Humphreys, vol. 15, No. 1, Jun., 1972, p. 179.

*Primary Examiner*—Ernest T. Wright, Jr.
*Attorney, Agent, or Firm*—Schuyler, Banner, Birch, McKie & Beckett

[57] ABSTRACT

An ink ribbon cartridge for a printing machine of the type which includes a carriage moving in a direction parallel to the line of typing and a needle printing head, which can move on the carriage perpendicular to its direction of movement to advance and retract the head with respect to that on which printing is effected. The cartridge is supported by the carriage and includes a container having a cover, a base and a series of inner walls which bound an opening to house the needle printing head. The cartridge comprises two arms to guide out a portion of an inked ribbon near the head. The container arranges the ribbon in loose folds and supports a pair of rollers for the single directional feed of the ribbon. A tensioning unit in the cartridge includes a roller borne by a coupling having two ends housed and guided in corresponding slots of the base and of the cover, substantially parallel to the direction of movement of the head in relation of the carriage. The coupling of the roller is able to house a stud of the head and is free to move with play in the slots. The roller engages the ribbon and is movable in a first direction to pay out ribbon to the external length as the head is advanced and is movable in a second opposite direction to take up slack from the external length as the head is retracted.

12 Claims, 5 Drawing Figures

INK RIBBON CARTRIDGE INCLUDING A MOVABLE RIBBON TENSIONING GUIDE FOR A PRINTING MACHINE

BACKGROUND OF THE INVENTION

The present invention relates to an ink ribbon cartridge for a printing machine in particular for a needle printing head fitted on to a movable carriage parallel to the proper guide roll and in which the head can be moved on the carriage perpendicular to its direction of movement.

A machine of the type described is known, in particular for printing on to bank books, in which the ribbon which is wound on to independent spools has a length guided by two ribbon guides arranged at the sides of the paper guide roll, parallel to the roll. The head is fitted with two lateral guides which bring that part of the ribbon placed opposite the typing area close to the roll. The printing head is, moreover, movable on the carriage perpendicular to the roll so as to follow the variations in thickness of the books by keeping constant the distance between the needles, the ribbon and the printing area in every position of the carriage along the line of typing. At each typing cycle, the needles bend the ribbon to maintain a spacing from the printing surface which is independent of the thickness of the book. During the movement of the head in relation to the carriage, the feed mechanism of the ribbon takes care of the ribbon which has to be paid out and that which has to be taken up as the head advances and retracts by keeping the ribbon subjected to a substantially constant tension. While being satisfactory, this solution is, however, somewhat expensive and also results in complications connected with the replacement of the ribbon wound on to independent spools.

A needle printer is also known which uses an ink ribbon cartridge fitted on to the carriage so as to guide a length of ribbon adjacent to the needles of the head in proximity to the paper guide roll. The printing head is fixed on to the carriage and the ribbon is fed by a single direction feed mechanism which is carried on the carriage which, by means of a pair of wires and pulleys is set in motion when the carriage is moved along the line of typing. This solution, which is economic and easy to use cannot, however, be used in printers with movable heads on the carriage, since the ribbon feed mechanism does not permit recovery of the ribbon which has been paid out and, if the carriage were to follow the movement of the head, this latter would require a specific feed mechanism to follow the movement of the cartridge support, thus increasing the mass of the moving parts and the overall cost of the machine.

SUMMARY OF THE INVENTION

The object of the invention is to provide an ink ribbon cartridge which is simple, of a relatively modest cost and which can be used in a needle printer in which the head can move in relation to the carriage.

According to the present invention there is provided an ink ribbon cartridge for a printer of the type which includes a carriage which supports the cartridge and moves in a direction parallel to the line of typing and a needle printing head, which can move on the carriage perpendicular to its direction of movement, to advance and retract the head with respect to that on which printing is effected, the cartridge comprising a ribbon housed in a container having two guides between which passes an external length of ribbon for engagement with the head, and a movable tensioning guide which engages the ribbon and is movable in a first direction to pay out ribbon to the external length as the head is advanced and is movable in a second, opposite direction to take up slack from the external length as the head is retracted.

In use, the movable guide is coupled to the head so that the necessary movements of the guide take place automatically as the head moves on the carriage, keeping the external length of ribbon under constant tension.

BRIEF DESCRIPTION OF THE DRAWING

The invention will be described in more detail, by way of example, with reference to the accompanying drawing, in which.

DESCRIPTION OF THE PREFERRED EMBODIMENT

Figure 1:
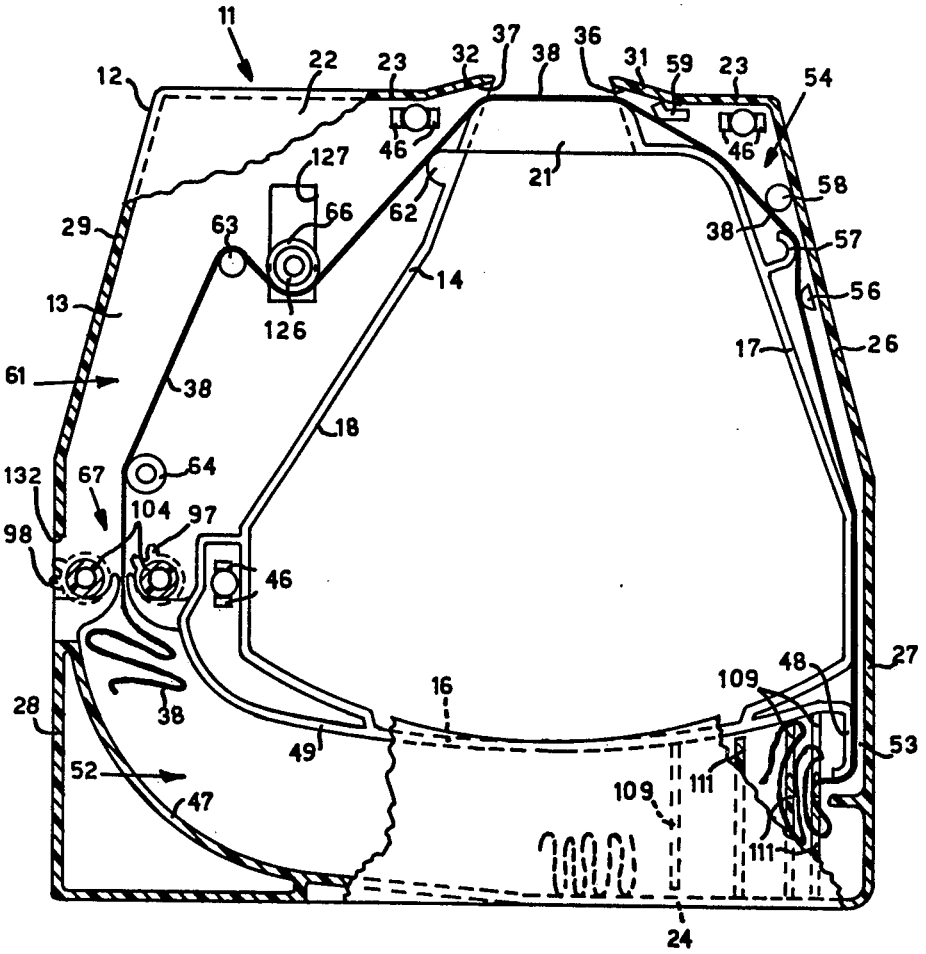
FIG. 1 is a partial plan view of a cartridge embodying the invention.

With reference to FIG. 1, a cartridge 11 for an ink ribbon 38 includes a container 12 of plastics material. The container 12 consists of a base 13 and of a series of inner walls 14, 16 and 17 which bound an opening 18 to house a needle printing head 19 (FIG. 2) which is carried by a carriage 43 of a printer 44. The walls 14 (FIG. 1) and 17 are joined together at the top by a cross piece 21 which strengthens the container walls 14 and 17 and forms them into a single unit. The container 12 is closed at the top by a cover 22, by a rear wall 23, by a front wall 24 and by side walls 26, 27, 28 and 29.

The cartridge 11 includes, projecting from the rear wall 23, two arms 31 and 32 which are closed at the top by a plate 33 (FIG. 2) of the cover 22, which are inclined outwardly and which have, at the ends, two openings 36 (FIG. 1) and 37 respectively to allow passage and to guide out a portion of the ink ribbon 38. The arms 31 and 32 are arranged at an angle in relation to the ends of the printing head 19 (FIG. 2) so that the external portion of ribbon 38 is the minimum. A second plate 39 of the cover 22 forms with the plate 33 a seat 41 for the cross piece 21.

The cartridge 11 is held fixed to the carriage 43 by means of three pins 42 on the carriage 43 so that each pin 42 is gripped by two flexible blades 46 bent up from the base 13 of the container 12.

A series of internal walls 47 (FIG. 1) 48 and 49 form the boundaries of a magazine 52, in which the ribbon 38 is arranged in loose folds. The magazine 52 is arranged on the side opposite to the openings 36 and 37 and is fitted with an outlet area formed by an opening or corridor 53 bounded by the walls 27 and 48 for the outlet of the ribbon 38, and with an entry area bounded by a pair of rollers 67 for the single directional feed of the ribbon 38. The space available for the ribbon 38 increases progressively along its length from the area of the rollers 67 to the outlet area 53. Furthermore, the base 13 and the cover 22 include respectively a series of ribs 109 and 111, which project towards the inside of the container 12, to reduce the density of the ribbon 38 as it is being transported to the area 53.

The walls 17, 23, 26 and 27 form a first corridor 54 in which the ribbon 38 is guided from the outlet area 53 by means of guides 56, 57, 58 and 59 to the opening 36. The walls 14, 23 and 29 form a second corridor 61 which is wider than the first and in which the ribbon 38 is guided from the opening 37 to the pair of rollers 67, by means of guides 62, 63 and 64 and a tensioning unit 66 which forms on the ribbon 38 a loop between the opening 37 and the guide 63. The magazine 52 and the two corridors 54 and 61 surround the printing head 19 completely (FIG. 2).

Figure 4:
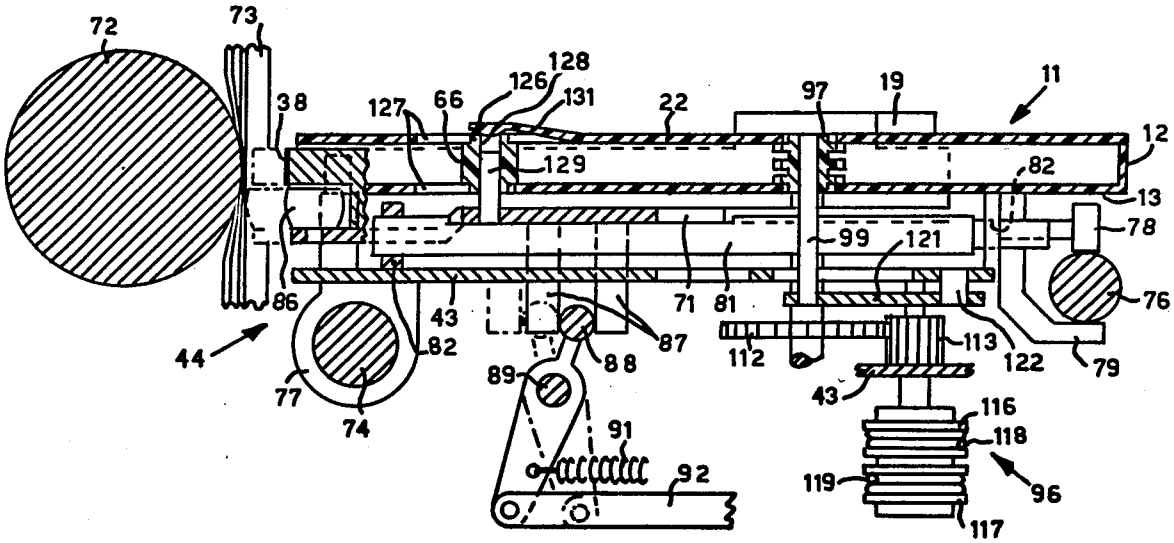
FIG. 4 is a partial section on the line 4—4 in FIG. 2.
Figure 5:
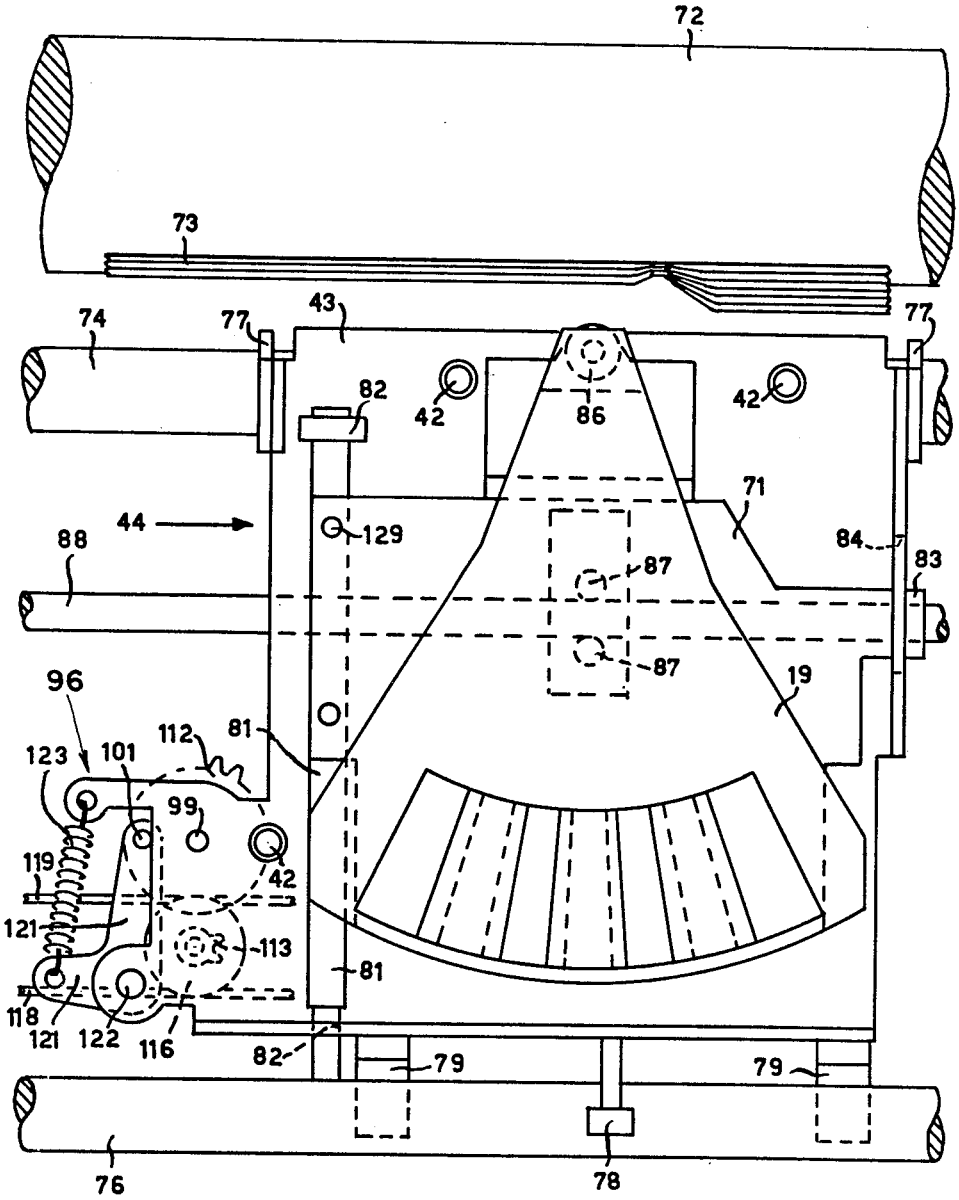
FIG. 5 is a partial plan view of the machine in FIG. 2.

The printer 44 (FIG. 5) includes a usual paper platen 72 on which there normally rests a document 73 of a variable thickness along the platen 72. The carriage 43 can be moved transversely to the document 73 along guides 74 and 76 and by means of sleeves 77, rollers 78 and counterrollers 79, in a known manner. The head 19 in turn is fixed on to a support 71 which is movable perpendicularly to the document 73 by means of a guide 81 and a tongue 83 which move smoothly in two sockets 82 and a slot 84 on the carriage 43, respectively. A roller 86 revolves on the support 71 and can rest against the document 73 to keep constant the distance between the end of the head 19 which bears the needles and the typing area of the document 73. The support 71 has two downwardly projecting pins 87 (FIG. 4) which straddle a universal bar 88 which turns about a shaft 89 parallel to the platen 72. The bar 88 is as long as the platen 72 and pushes the support 71 towards the document 73 under the action of a spring 91. A lever 92, controlled manually for example, holds the support 71 at a distance of approximately 8 mm from the platen 72 in order to facilitate the introduction and the reading of the document 73. When the lever 92 is released, the spring 91 turns the universal bar 88 in an anti-clockwise direction, (in FIG. 4), bringing the roller 86 against the document 73 as shown in broken lines in FIG. 4 to bring the end of the head 19 to a distance of approximately 0.7 mm from the document 73. The roller 86 and the bar 88 then keep this distance constant during the movement of the carriage 43, following the variations in the thickness of the document 73.

The pair of rollers 67 in the cartridge 11 (FIG. 1) are able to engage with a feed device 96 fitted on to the carriage 43 (FIG. 4), and as described in U.S. patent application Ser. No. 863,420 of Bernardis et al., filed on Dec. 22, 1977. The pair of rollers 67 (FIG. 1) includes a driving roller 97 and a pressure roller 98, each fitted with a hollow sleeve 104 which is able to be engaged by a driving pin 99 (FIG. 2) and by a pressure pin 101 on the feed device 96, respectively. The driving roller 97 and the pressure roller 98 are free to move radially in corresponding seats 102 and 103 in the base 13 and the cover 22 respectively in order to facilitate the engaging of the sleeves 104 with the pins 99 and 101 during the fitting of the cartridge 11.

Figure 2:
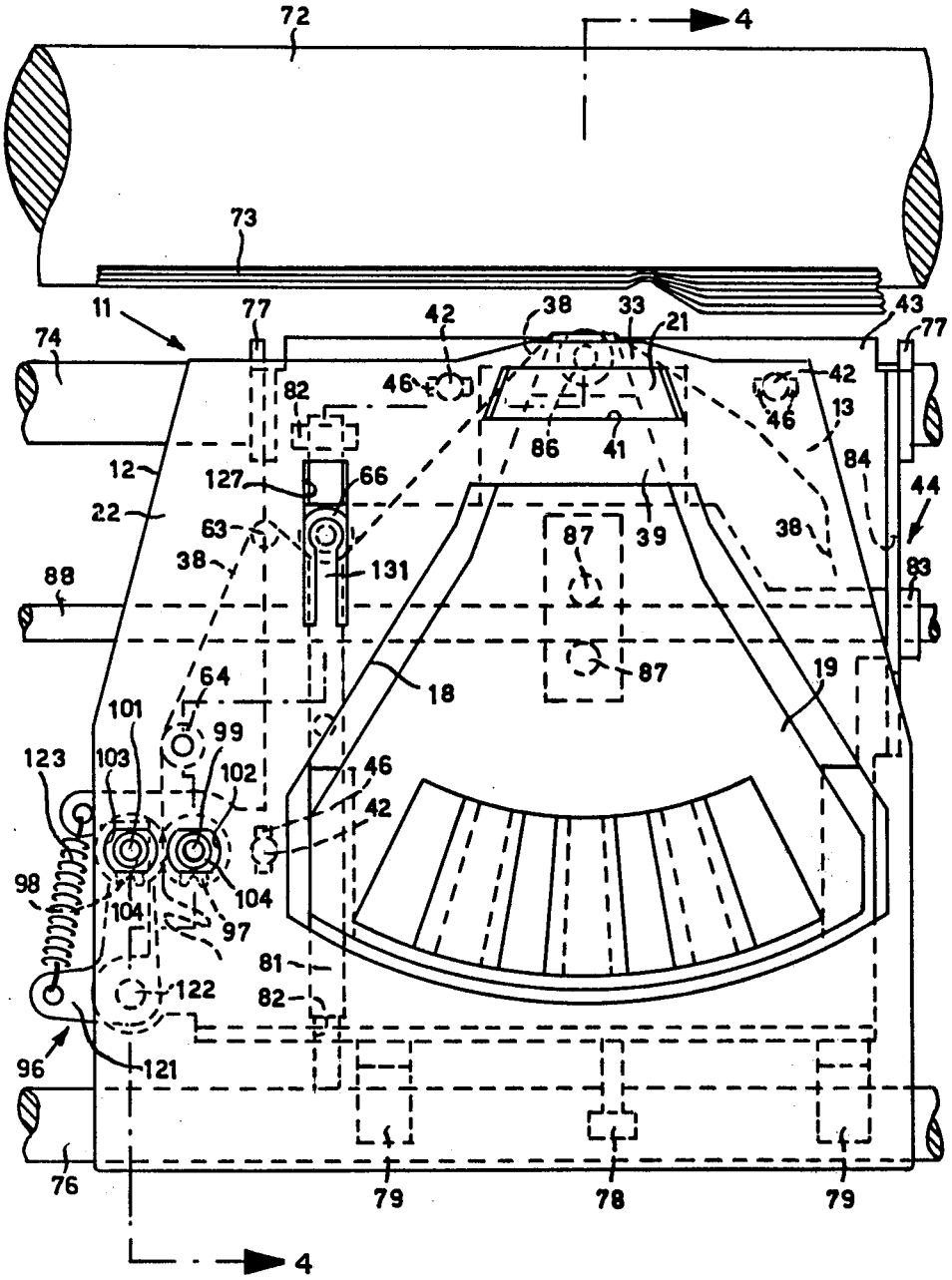
FIG. 2 is a partial plan view of a printer on to which the cartridge in FIG. 1 is fitted.
Figure 3:
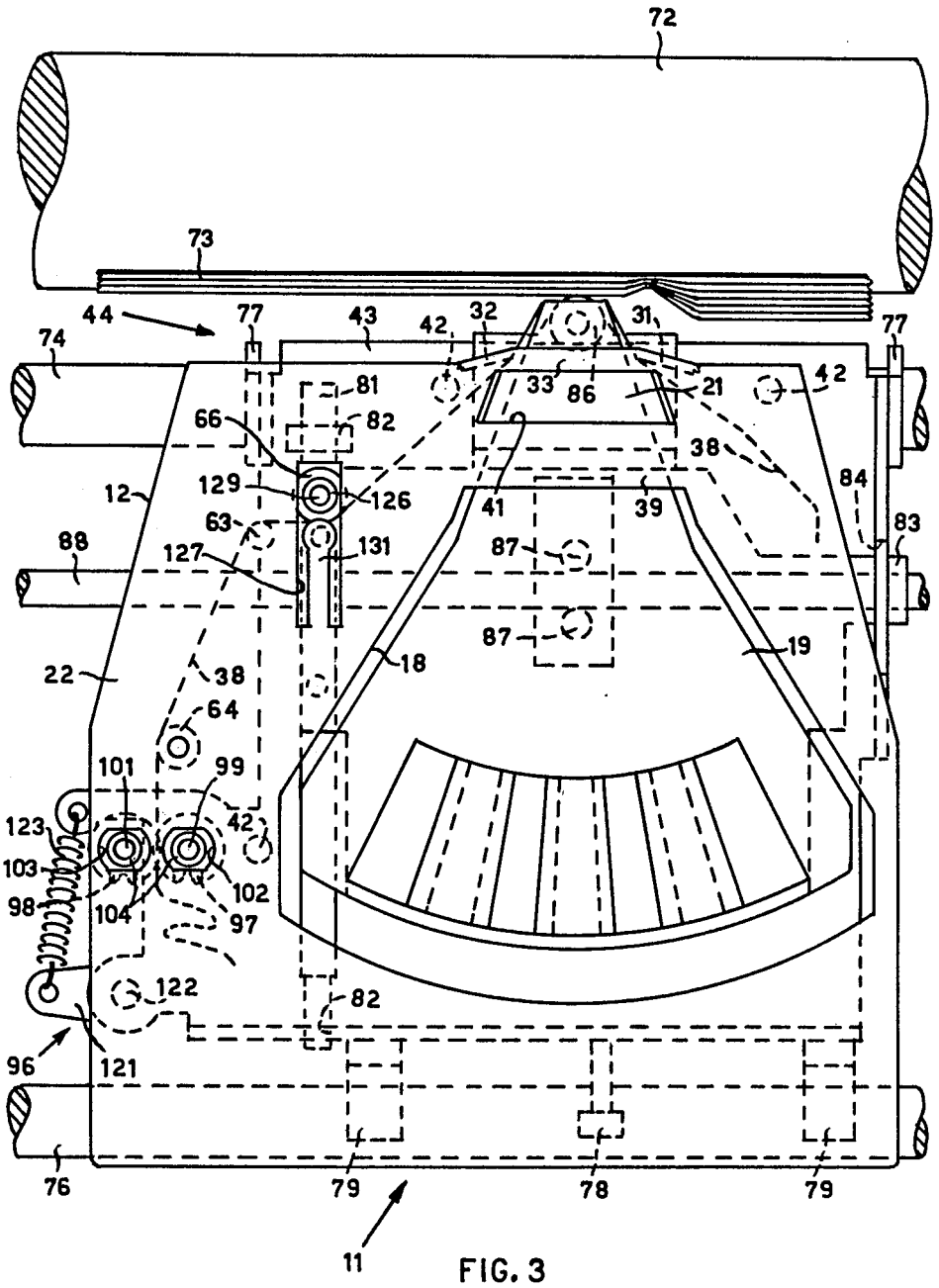
FIG. 3 is a partial plan view of the machine in FIG. 2 in the working position.

In particular, the driving pin 99 (FIG. 4) is, by means of a pair of gears 112 and 113 which revolve on the carriage 43 and a free wheel device already known such as the one-way clutch 29 shown in FIG. 2 of Bittner U.S. Pat. No. 3,939,957, turned in one direction by two pulleys 116 and 117. For this purpose, two wires 118 and 119 are stretched parallel to the platen 72 and each is wound on to its respective pulley 116 and 117 in a direction opposite to one another. Following a movement of the cartridge 43, the two wires 118 and 119 make the respective pulleys 116 and 117 turn in opposite directions; from movement in a first direction, one pulley 116 or 117 transmits movement to the pin 99 while the other pulley 117 or 116 remains idle; when the opposite occurs, when movement takes place in the opposite direction, the roles reverse between the pulleys 116,117 so that the pin 99 always turns in the same direction. The pressure pin 101 (FIG. 5) is, in its turn, fixed on to a bellcrank 121 which is supported on a pin 122 in the carriage 43, while a spring 123 normally holds the pin 101 at rest against a side of the carriage 43.

The tensioning unit 66 in the cartridge 11 (FIG. 1) includes a roller borne by a coupling 126 having two ends housed and guided in corresponding slots 127 of the base 13 and of the cover 22. The slots 127 are substantially parallel to the direction of movement of the head 19 in relation to the carriage 43 (FIG. 2). The coupling 126 of the roller 66 is able to house a corresponding stud or dragging element 129 (FIG. 4) of the support 71 and is free to move with play in the slots 127. Furthermore, a flexible tongue 131, formed by a piece of the cover 22, is fitted into the corresponding slot 127 and is able to engage with the upper end of the coupling 126 to hold the roller 66 in a position of rest with a maximum loop of the ribbon 38, when the cartridge 11 is removed from the machine 44. This makes it possible to align the stud 129 of the head 19 with the coupling 126 during the fitting of the cartridge 11 on to the machine 44 when the head 19 is at a distance from the platen 72.

For the purposes of fitting, the cartridge 11 (FIG. 2) is placed at an angle with the ribbon 38 emerging from the arms 31 (FIG. 1) and 32 being arranged on the leading edge of the head 19 (FIG. 2): the pins 42 are then engaged between the flexible blades 46 and the stud 129 (FIG. 4) enters the seat 128. A slight pressure is exercised on the cover 22, with the cartridge 11 being lowered towards the carriage 43. During this operation, the pins 99 and 101 positioned as in FIG. 5, engage the sleeves 104; the pressure roller 98 then moves the pressure pin 101 away from the driving pin 99. The spring 123 pushes the bellcrank 121 in a clockwise direction and the pressure pin 101 brings the pressure roller 98 closer to the drive roller 97, to leave a length of the ribbon 38 nipped between the rollers 97 and 98. An opening 132 in the cartridge 11 (FIG. 1) makes it possible to rotate the pressure roller 98 manually to tension the ribbon 38 if it has slackened.

The working of the tensioning unit 66 in the cartridge 11 (FIG. 4) is as follows. Once the lever 92 is released, the spring 91 turns the universal bar 88 in an anti-clockwise direction; by means of the pins 87, this latter makes the support 71 with the head 19 move backwards (towards the left in FIG. 4), bringing the roller 86 to rest against the document 73 fixed in the position shown by broken lines.

During this movement, the head 19 with its end moves back the portion of ribbon 38 which normally rests against the head 19 itself and, at the same time, with the stud 129, makes the roller 66 in the slots 127 slip towards the paper platen 72. The movement of the head 19 with the ribbon 38 is identical to the stroke of the roller 66; consequently, there is no movement of the ribbon 38 in the corridor 61 but only a reduction in the loop in the element 66 in relation to the original position. If a part of the document 73 of considerable thickness is met with during the feed of carriage 43, the roller 86 moves forward the support 71 with head 19 (towards the right in FIG. 4) to return to the position of rest. Under the action of the tensioning unit 66, the ribbon 38 slips forward at the same time as the head 19 and remains tensioned and at the working distance from the document 73, thereby avoiding any risk of slackening or of undesirable contact with the document 73. The same thing happens when, at the end of the typing, the lever 92 is worked to bring the head 19 to its position of rest at the maximum distance from the roll 72.

It is, therefore, obvious that the tensioning unit 66 of the ribbon 38 keeps the ribbon 38 constantly tense in any position of the head 19 in relation to the carriage 43.

We claim:

1. An ink ribbon cartridge for a printing machine of the type which includes a platen to support a record medium having variable thickness, a carriage movable parallel to the platen along a printing line and comprising a support member whereon the cartridge can be fitted, a needle printing head actuatable for the printing, a dragging element, and means supporting said head and said dragging element for movement thereof with respect to the carriage perpendicular to said printing line for causing said head to advance and retract with respect to said platen but remaining at a constant distance from the record medium; said cartridge comprising an inked ribbon, a container having means housing the ink ribbon and including two guides between which passes an external length of the ribbon for engagement with the head, and a movable tensioning guide which is movably fitted onto the container between said housing means and one of said two guides, which movably engages the ribbon and which comprises means for engaging said dragging element when the cartridge is fitted on the support member of said carriage, wherein said movable tensioning guide follows said dragging element toward the platen to pay out the ribbon to the external length as the head is advanced toward the platen and to take up slack from the external length as the head is retracted from the platen, thereby holding constant the tension and the length of said external length of the ribbon in spite of the movement of the needle printing head with respect to the support member of the carriage.

2. An ink ribbon cartridge for a printing machine in accordance with claim 1, wherein the machine comprises means for retracting the head from the platen up to a rest position and wherein said cartridge further comprises means for releasably positioning said movable tensioning guide at a predetermined position to facilitate the engagement of the engaging means of said tensioning guide with said dragging element, when the cartridge is fitted on the support member of the carriage in rest position of the needle printing head.

3. An ink ribbon cartridge according to claim 11, wherein the dragging element of the machine comprises a stud, wherein the cartridge comprises a bottom and a cover each including a slot substantially parallel to the direction of movement of the needle printing head in relation to the carriage, wherein the movable tensioning guide of the cartridge comprises a roller having two ends, wherein one of said ends is guided in the slot of said bottom and comprises a hole for the engagement of said stud, and wherein said ends are free to move with clearance in said slots in response of the movement of said printing head.

4. An ink ribbon cartridge according to claim 3 wherein said means for releasably positioning said tensioning guide comprises a flexible tongue projecting on the slot of the cover of the container having means for releasably engaging the other of said two ends of said roller.

5. A cartridge in accordance with claim 1, wherein the ribbon is arranged in loose loops, and the container includes a bottom and a cover, which form corridors for the ribbon feeding to and returning from said two guides and said housing means and a series of inner walls, which bound an opening for receiving the head, and, wherein said opening is disposed between said corridors.

6. A cartridge according to claim 5 wherein said bottom and said cover comprise slots and the movable tensioning guide is housed in one of said corridors and is guided by the slots of the bottom and of the cover.

7. A cartridge in accordance with claim 6, wherein the slots are substantially perpendicular to said printing line.

8. A cartridge in accordance with claim 6, wherein the dragging element includes a stud, wherein the movable tensioning guide includes a roller having two ends wherein one of said ends comprises a hole engageable by said stud and wherein said ends are free to move with clearance in the slots, in order to facilitate engagement with said stud during the fitting of the cartridge onto the machine.

9. A cartridge in accordance with claim 1, wherein the movable tensioning guide is a roller engaging with the ribbon and forming a loop, the length of which varies, in use, in dependence on the distance of the head from the platen.

10. A cartridge in accordance with claim 9, wherein the container includes a slotted cover and bottom and wherein the roller has two ends housed in the slots of said cover and bottom.

11. A cartridge in accordance with claim 10, wherein the cover includes a flexible tongue which is able to engage with one of said ends of the roller to hold said roller in a position of rest when the cartridge is removed from the machine.

12. A cartridge in accordance with claim 11, wherein the tongue is housed in one of said slots and is integral with the cover.

* * * * *